US005545238A

United States Patent [19]

Brooker et al.

[11] Patent Number: 5,545,238

[45] Date of Patent: Aug. 13, 1996

[54] METHOD OF MONITORING SLAG REMOVAL DURING CONTROLLED OXIDATION OF A PARTIAL OXIDATION REACTOR

[75] Inventors: Donald D. Brooker, Hopewell Junction, N.Y.; James S. Falsetti, New Fairfield, Conn.; James K. Wolfenbarger, Torrance, Calif.; Dinh-Cuong Vuong, Nederland, Tex.

[73] Assignee: Texaco Inc., White Plains, N.Y.

[21] Appl. No.: 365,783

[22] Filed: Dec. 29, 1994

[51] Int. Cl.[6] ..... C10J 3/08

[52] U.S. Cl. ..... 48/197 R; 48/206; 48/215; 48/DIG. 2; 252/373

[58] Field of Search ..... 48/197 R, 203, 48/206, 210, DIG. 2, 212, 215; 252/373; 110/165 R, 171, 185, 186; 266/45, 78

[56] References Cited

U.S. PATENT DOCUMENTS

| | | | |
|---|---|---|---|
| 4,073,627 | 2/1978 | Anderson | 48/DIG. 2 |
| 4,331,450 | 5/1982 | Elliott | 266/45 |
| 4,455,441 | 5/1984 | Tanca | 110/171 |
| 4,511,371 | 4/1985 | Blaskowski | 48/DIG. 2 |
| 4,525,176 | 6/1985 | Koog et al. | 48/197 R |
| 4,722,610 | 2/1988 | Levert et al. | 110/185 |
| 4,834,778 | 5/1989 | Segerstrom et al. | 48/DIG. 2 |
| 4,954,137 | 9/1990 | Potter | 48/DIG. 2 |
| 4,963,163 | 10/1990 | Clomburg et al. | 48/DIG. 2 |
| 5,112,366 | 5/1992 | Liu | 48/DIG.2 |
| 5,281,243 | 1/1994 | Leininger | 48/197 R |
| 5,338,489 | 8/1994 | Jung et al. | 252/373 |

*Primary Examiner*—Peter Kratz
*Attorney, Agent, or Firm*—Kenneth R. Priem; Richard A. Morgan

[57] ABSTRACT

The progress and completion of slag removal from the quench chamber of a partial oxidation reactor during controlled oxidation can be monitored by measuring such quench water parameters as pH, conductivity, total dissolved solids, and sulfate concentration.

10 Claims, 5 Drawing Sheets

CONTROLLED OXIDATION - QUENCH WATER pH

CONTROLLED OXIDATION - QUENCH WATER CONDUCTIVITY

CONTROLLED OXIDATION - TOTAL DISSOLVED SOLIDS

CONTROLLED OXIDATION – SULFATE CONCENTRATION

METHOD OF MONITORING SLAG REMOVAL DURING CONTROLLED OXIDATION OF A PARTIAL OXIDATION REACTOR

BACKGROUND OF THE INVENTION

1. Field of the Invention

This invention relates to a method of monitoring the progress and completion of slag removal in a partial oxidation reactor during controlled oxidation.

2. Description of the Prior Art

Fuels such as petroleum coke, residual fuel oils or other contaminated hydrocarbonaceous materials that undergo partial oxidation in a partial oxidation reactor produce a slag byproduct that can collect and build up deposits on the inside surface of the reactor or the reactor outlet to an amount that prevents effective partial oxidation. Periodic shutdown of the partial oxidation reactor then becomes necessary to remove slag, in an operation commonly referred to as "controlled oxidation" or "deslagging."

The slag-depositing material in the fuel or feedstock of the partial oxidation reactor exists as an impurity or contaminant. The constituency of the slag-depositing material can vary depending upon the feedstock and its source.

The slag-depositing material has a slagging component, which is an element or compound that, alone or in combination with another material in the reactor, such as oxygen or sulfur, forms slag. Slagging elements include transition metals, such as vanadium, iron, nickel, tantalum, tungsten, chromium, manganese, zinc, cadmium, molybdenum, copper, cobalt, platinum, palladium; alkali and alkaline earth metals, such as sodium, potassium, magnesium, calcium, strontium, or barium; and others including aluminum, silicon, phosphorus, germanium, gallium, and the like. The amount of slagging elements in the feedstock generally varies from about 0.01 to about 5 weight %.

A typical charge to a partial oxidation reactor includes the feedstock, a free-oxygen containing gas and any other materials that may enter the burner located in the reactor inlet. The partial oxidation reactor is also referred to as a "partial oxidation gasifier reactor" or simply a "reactor" or "gasifier," and these terms are used interchangeably throughout the specification.

Any effective burner design can be used, although typically a vertical, cylindrically shaped steel pressure vessel with a reaction zone preferably comprising a down-flowing, free-flow refractory lined chamber with a centrally located inlet at the top and an axially aligned outlet at the bottom is preferred.

These reactors are well known in the art, as are the partial oxidation reaction conditions. See, for example, U.S. Pat. Nos. 4,328,006 and 4,328,008, both to Muenger, et al., U.S. Pat. No. 2,928,460 to Eastman, et al., U.S. Pat. No. 2,809,104 to Strasser et al., U.S. Pat. No. 2,818,326 to Eastman et al., U.S. Pat. No. 3,544,291 to Schlinger et al., U.S. Pat. No. 4,637,823 to Dach, U.S. Pat. No. 4,653,677 to Peters et al., U.S. Pat. No. 4,872,886 to Henley et al., U.S. Pat. No. 4,456,546 to Van der Berg, U.S. Pat. No. 4,671,806 to Stil et al. , U.S. Pat. No. 4,760,667 to Eckstein et al., U.S. Pat. No. 4,146,370 to van Herwijner et al., U.S. Pat. No. 4,823,741 to Davis et al., U.S. Pat. No. 4,889,540 to Segerstrom et al., U.S. Pat. Nos. 4,959,080 and 4,979,964, both to Sternling, and U.S. Pat. No. 5,281,243 to Leininger.

The partial oxidation reaction is conducted under reaction conditions that are sufficient to convert a desired amount of feedstock to synthesis gas or "syngas." Reaction temperatures typically range from about 900° C. to about 2,000° C., preferably from about 1,200° C. to about 1,500° C. Pressures typically range from about 1 to about 250, preferably from about 10 to about 200 atmospheres. The average residence time in the reaction zone generally ranges from about 0.5 to about 20, and normally from about 1 to about 10 seconds.

The syngas reaction product leaving the partial oxidation reactor generally includes CO, $H_2$, steam, $CO_2$, $H_2S$, COS, $CH_4$, $NH_3$, $N_2$, volatile metals and inert gases such as argon. The specific product composition will vary depending upon the composition of the feedstock and the reaction conditions. Non-gaseous byproducts include particulate materials, generally carbon and inorganic ash, much of which is entrained in the product stream and carried out of the reactor. Some of the non-gaseous byproducts contact the inside surfaces of the reactor and adhere thereto as slag.

Slag is essentially fused mineral matter, such as ash, the byproduct of the slag-depositing material in the feedstock. Slag can also include carbonaceous materials, such as soot. Slag materials also include oxides and sulfides of transition metals such as vanadium, molybdenum, chromium, tungsten, manganese, and palladium, which can be recovered as valuable byproducts of the slag.

The molten slag that flows out of the reactor is generally collected in a quench chamber. Slag that accumulates in the quench chamber can be discharged periodically to slag trapping means, such as a lockhopper or other suitable vessel.

Slag that has a higher melting point than the reactor temperature conditions generally builds up as solid deposits in the reactor, most often on the refractory surfaces lining the reactor. Slag deposits tend to increase as the gasification reaction proceeds, and can build up to a level where removal or deslagging becomes desirable or necessary.

When the need for slag removal arises, the gasification reaction is stopped and "controlled oxidation" or deslagging commences. Controlled oxidation conditions in the reactor are designed to melt out and remove the accumulated slag.

Deslagging is also warranted when slag buildup occurs in the quench chamber. Such slag buildup in the quench chamber can cause premature shutdown of the partial oxidation reactor since the slag can fill the quench chamber and restrict the gas path to the throat of the reactor.

The slag is generally physically removed, such as by chipping it away from the refractory surfaces and/or by drilling it out from the openings or passages that have become partially or completely blocked by the slag. Needless to say, such methods of slag removal can damage the reactor and must be conducted very carefully.

To obtain maximum deslagging rates, the gasifier temperature during controlled oxidation should operate at a temperature of about 1000° C. to 1500° C. and preferably about 1100° C. to 1400° C.

During the controlled oxidation reaction, the partial pressure of oxygen is increased in the gasifier to convert the high melting temperature $V_2O_3$ phase into the lower melting temperature $V_2O_5$ phase. Any free-oxygen-containing gas that contains oxygen in a form suitable for reaction during the partial oxidation process can be used. Typical free-oxygen-containing gases include one or more of the following: air; oxygen-enriched air, meaning air having greater than 21 mole percent oxygen; substantially pure oxygen, meaning greater than 95 mole percent oxygen; and other suitable gas. Commonly, the free-oxygen-containing gas contains oxygen plus other gases derived from the air from which oxygen was prepared, such as nitrogen, argon or other inert gases.

The partial pressure of oxygen is generally gradually increased during controlled oxidation from about 1.0% to about 10% at a pressure of about 10–200 atmospheres in the partial oxidation reactor over a period of about 2 to 24 hours.

Various means for the detection and monitoring of slag accumulation in the reactor or its outlet have been attempted. The monitoring of slag buildup is important to determine when deslagging is needed and thereby anticipate the need for deslagging in advance of reactor shutdown. It is also important to monitor slag removal during deslagging or controlled oxidation to measure the progress and completion of the deslagging operation.

Slag deposits can be visually observed by means of a borescope mounted in the reactor opening and positioned to provide a view of the reactor walls or outlet. Visual observation can also be made with fiber optics sited by the burner to detect light radiating from the slag or refractory in the reactor outlet or other area. Nuclear or sonar detection can also be used to measure variations in slag thickness.

The use of thermocouples mounted in different reactor locations can provide information about variations in temperature measurements, that is, a temperature profile along the reactor walls to enable the detection of accumulating slag deposits.

Pressure change in the reactor has also been measured to monitor the presence of slag deposits, since increasing slag deposits in the reactor outlet can constrict gas flow through the outlet and build up measurable pressure within the reactor. Correspondingly, pressure drops in the reactor can indicate a clearing of slag deposits that obstruct the reactor outlet.

Despite the availability of known methods for monitoring slag buildup in the reactor, a major drawback of these methods is their degree of difficulty and cost to monitor the progress and completion of slag removal in the partial oxidation reactor during controlled oxidation.

SUMMARY OF THE INVENTION

In accordance with the present invention, the progress and completion of slag removal in a partial oxidation reactor during controlled oxidation can be monitored by measuring the quench water parameters such as pH, conductivity, total dissolved solids, and sulfate concentration.

DESCRIPTION OF THE PREFERRED EMBODIMENTS

Figure 1:
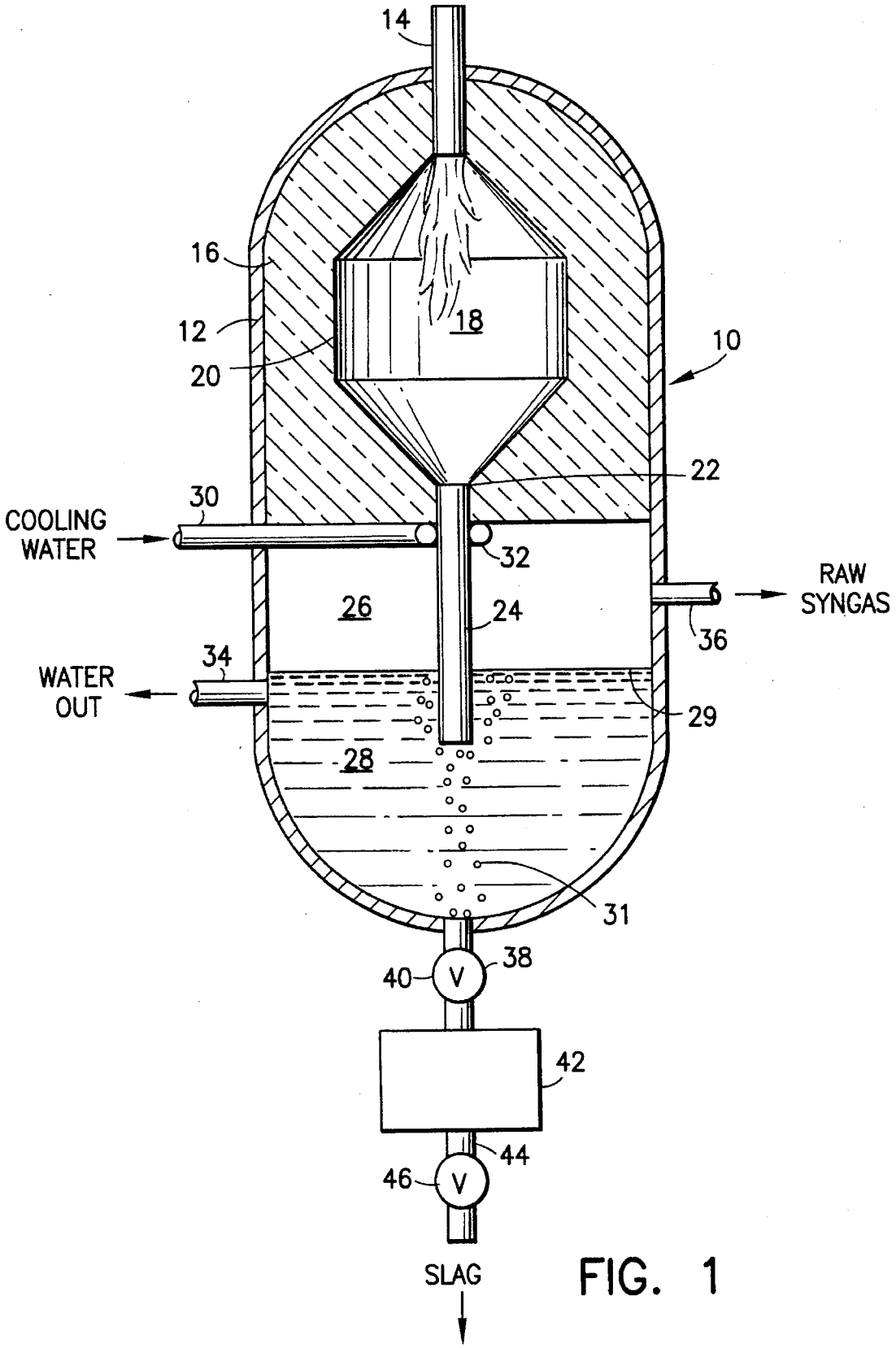
FIG. 1 is a simplified diagrammatic representation of a partial oxidation reactor system.

Referring to FIG. 1, a partial oxidation reactor 10, is provided with a steel shell 12, a burner 14 and refractory material 16 that forms a reaction chamber 18.

The partial oxidation process yields raw syngas and slag which gravitates towards the wall 20 of the chamber 18 and flows downwardly to the bottom of the chamber 18 and out through a constricted throat 22 from which a dip tube 24 extends into a quench chamber 26 formed by a lower portion of the shell 12. Dip tube 24 extends into a pool of quench water 28.

Cooling water enters a line 30 and passes into a quench ring 32 where it flows against the walls of the dip tube 24 into the pool of quench water 28. During the partial oxidation process, the quench water 28 serves to cool the raw syngas and slag, and thereby increases in temperature. A portion of the heated quench water 28 exits through a line 34. The cooling water provided through the line 30 and the portion of heated quench water 28 removed by the line 34 is controlled to maintain a desired level 29 of the quench water 28.

The raw syngas bubbles 31 rise up to that portion of chamber 26 above the water level 29 and are removed through a line 36. The heavy slag (not shown) sinks to the bottom of the quench chamber 26 and exits through a line 38 having a valve 40. Line 38 is connected to slag trap means such as a lockhopper 42 which is connected to a line 44 having a valve 46. During normal operation, the valve 40 is open and the slag passes through the line 38 and is trapped in the lockhopper 42 when the valve 46 is closed. The accumulated slag is removed by closing the valve 40 and opening the valve 46.

When molten slag is added to an aqueous medium, such as the water in the quench chamber of a partial oxidation reactor, the presence of the slag components in the quench water will reduce the pH of the water. The pH of the quench water where the slag accumulates generally varies from about 3.0 to about 8.5.

As controlled oxidation conditions proceed in the partial oxidation reactor, there will be an increase in the amount of slag that is removed from the walls of the reactor and accumulates in the quench chamber. The decrease in pH directly corresponds to the increase in slag removal from the walls of the reaction chamber. The pH will increase as lesser amounts of slag are removed from the reactor. The steady and consistent rise in pH during controlled oxidation conditions after the pH has reached a minimum is an indication that most of the slag has been removed and that the reactor can return to partial oxidation conditions.

During controlled oxidation, the sulfide content of the slag accumulating in the quench chamber of the gasifier or partial oxidation reactor is oxidized to sulfate and dissolves in the quench water. The soluble sulfate ions in the quench water reduce the pH and thereby serve to evidence the removal of slag therein.

Figure 2:
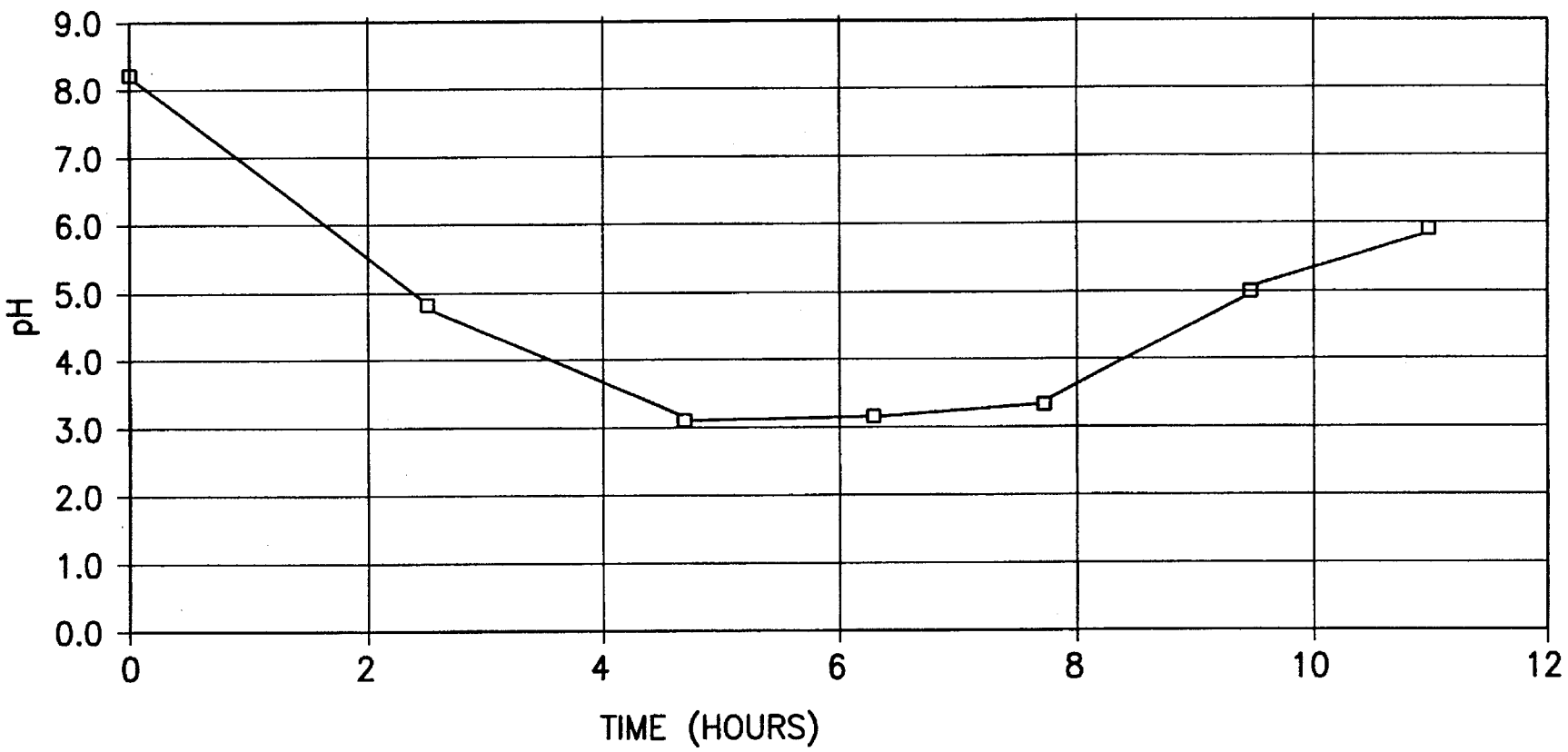
FIG. 2 is a graph depicting the progression in pH measurement of the quench chamber water of the partial oxidation reactor during controlled oxidation.

FIG. 2 is a graph depicting the pH profile or progression of pH measurement of the quench chamber water of the partial oxidation reactor during controlled oxidation. The monitoring of the pH of the quench water can be accomplished at any convenient location such as the quench water outlet line. Any suitable commercially available pH meter with a recorder can be adapted for this purpose, and these devices are well known to those skilled in the art.

Typical installation of the pH meter is the common in-line method well known to those skilled in the art, which includes two valves on each side of the pH probe installed in the quench water outlet line, with a bypass line. An installation of this type enables convenient replacement of the pH probe without interruption of the process. In addition, the signal from the pH meter can be connected to a remote recorder in a suitable location such as the control room wherein other parameters of the partial oxidation and controlled oxidation conditions can be measured, monitored and controlled remotely in a central location.

Slag accumulation in the quench water can also be detected by measuring the conductivity of the quench water during controlled oxidation. As already noted, during controlled oxidation, the sulfide content of the slag in the gasifier is oxidized to sulfate and dissolves in the quench water, thereby increasing the conductivity. The dissolved sulfate content of the quench water is the main slag component that raises the conductivity.

Figure 3:
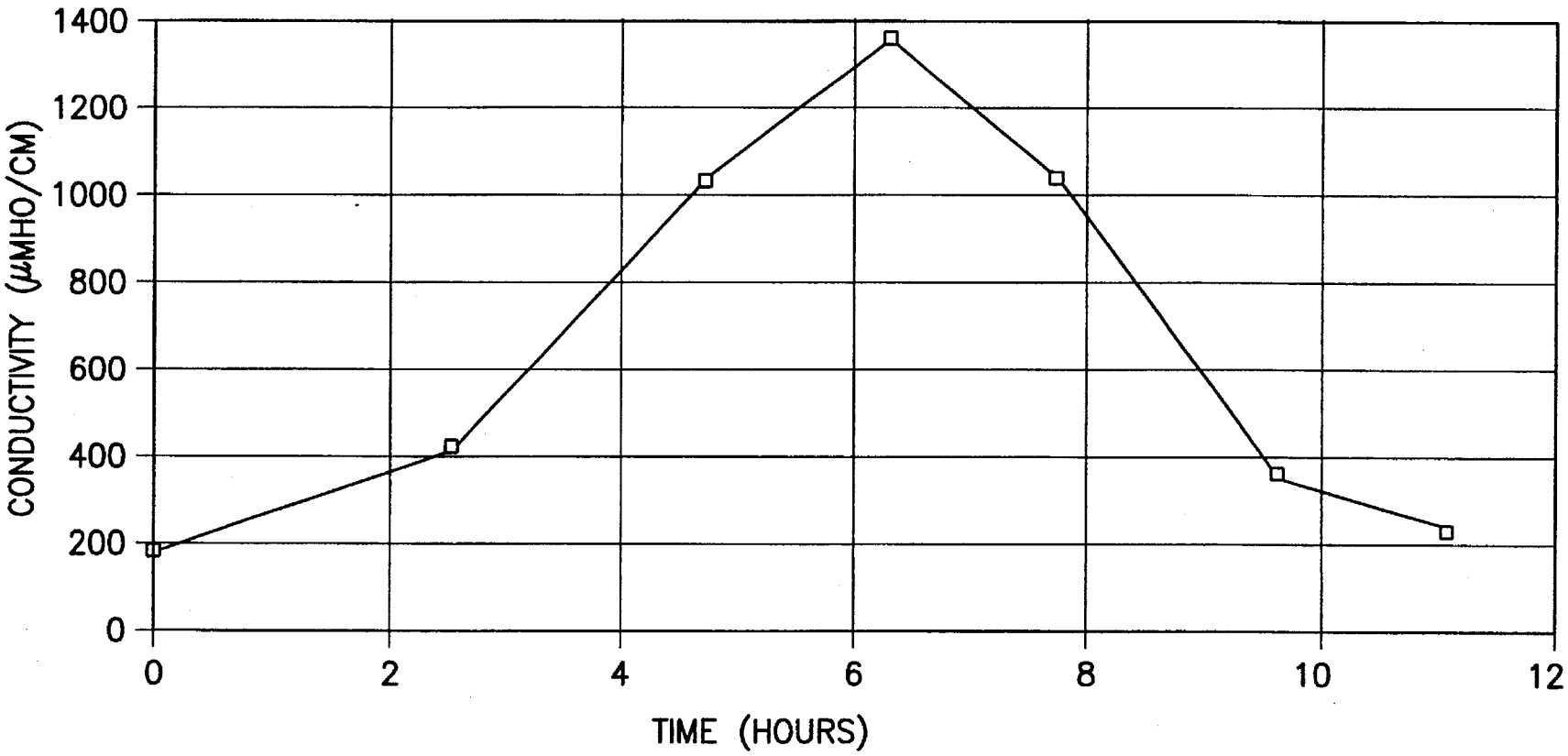
FIG. 3 is a graph depicting the progression in conductivity measurement of the quench chamber water of the partial oxidation reactor during controlled oxidation.

FIG. 3 is a graph depicting the conductivity profile, or progression in quench water conductivity measurement during controlled oxidation. The increase in conductivity of the quench water during controlled oxidation is an indication of the increasing amount of slag removal from the gasifier. When there is a consistent and steady decrease in conductivity measurements, it is an indication that lesser amounts of slag are being removed from the gasifier into the quench chamber water. This is an indication that controlled oxidation conditions have effectively removed the slag from the reactor. Any suitable commercially available conductivity meter with a recorder can be adapted for measuring the conductivity of the quench chamber water, and its installation is in a manner similar to that of the pH meter.

Another means for monitoring the progress of controlled oxidation is by measuring the amount of total dissolved solids (TDS) in the quench water. As components of the molten slag dissolve in the quench water, there will be a corresponding increase in the amount of total solids dissolved in the quench water, and this will increase the TDS measurement.

Figure 4:
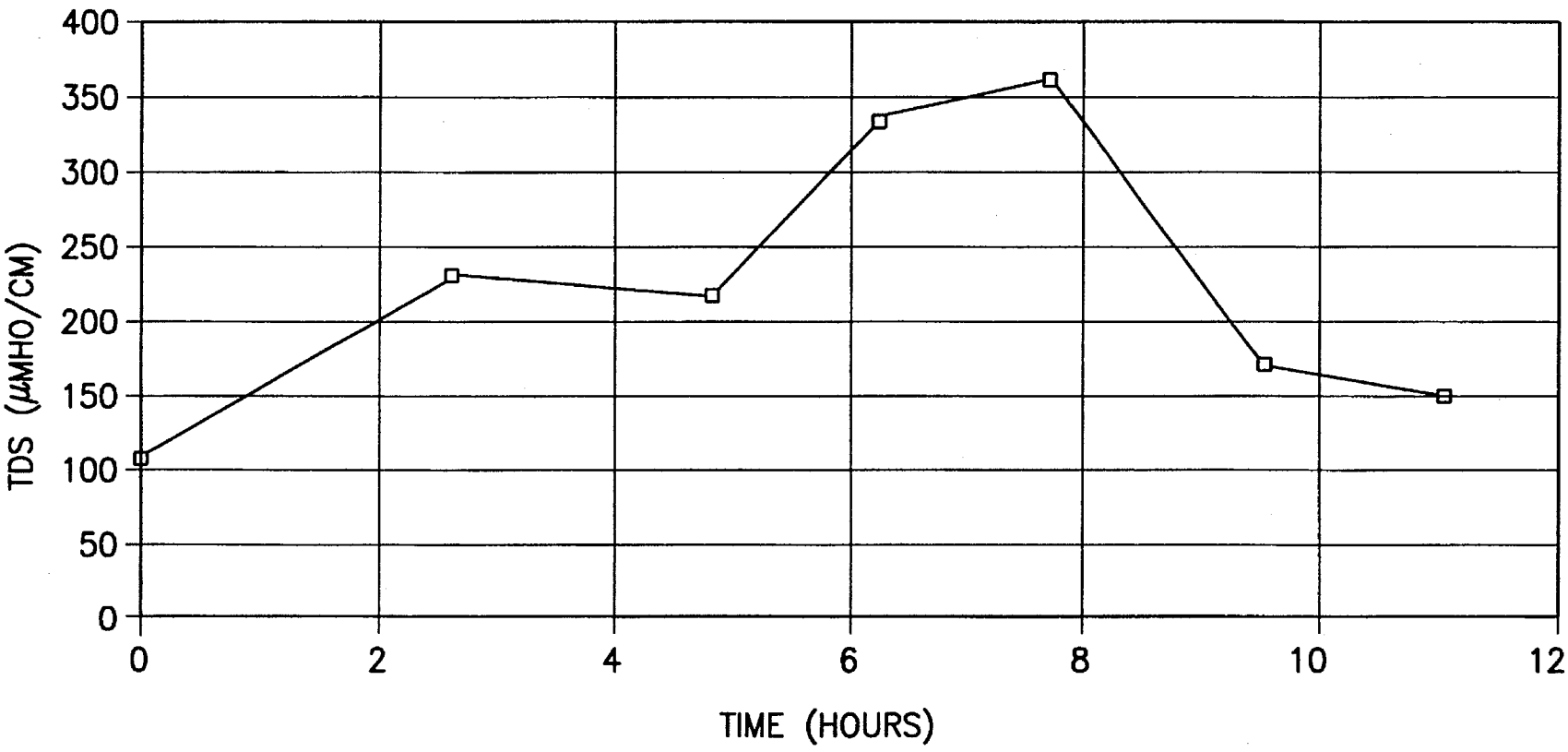
FIG. 4 is a graph depicting the progression in total dissolved solids measurement of the quench chamber water of the partial oxidation reactor during controlled oxidation.

FIG. 4 is a graph depicting the TDS profile, or the progression in total dissolved solids measured during controlled oxidation. As the TDS measurement reaches a maximum, it is an indication that most of the slag has been removed from the reactor. Thus, when the TDS measurements show a consistent and steady decrease, lesser amounts of slag are being removed from the reactor into the quench chamber water. This reflects the fact that controlled oxidation conditions have effectively removed most of the slag from the reactor, that controlled oxidation conditions can be stopped, and that partial oxidation conditions can be restored to the reactor.

Any suitable commercially available in-line total dissolved solids measurement instrument can be adapted for measuring the total dissolved solids in the quench water, and its installation is in a manner similar to that of the pH meter. The methodology for measuring total dissolved solids in the laboratory is also well known to those skilled in the art and is conducted in accordance with Test Method 2540C "Standard Methods for the Examination of Waste and Waste Water," (18th Edition 1992, American Public Health Association et al), the disclosure of which is incorporated by reference herein.

Another method for monitoring the accumulation of slag in the quench water during controlled oxidation is by measuring the sulfate concentration of the quench water. The methodology for measuring sulfate concentration in the laboratory is well known to those skilled in the art and is conducted in accordance with Test Method 4110B, "Standard Methods for the Examination of Water and Waste Water," (18th Edition 1992, American Public Health Association et al), the disclosure of which is incorporated by reference herein.

The sulfate concentration can also be determined by ion chromatography from a small amount of quench water sample, in a manner well known to those skilled in the art.

Instrumentation is also available for measuring sulfate concentration directly, however, it is more expensive than pH meters, conductivity meters or TDS instrumentation.

Figure 5:
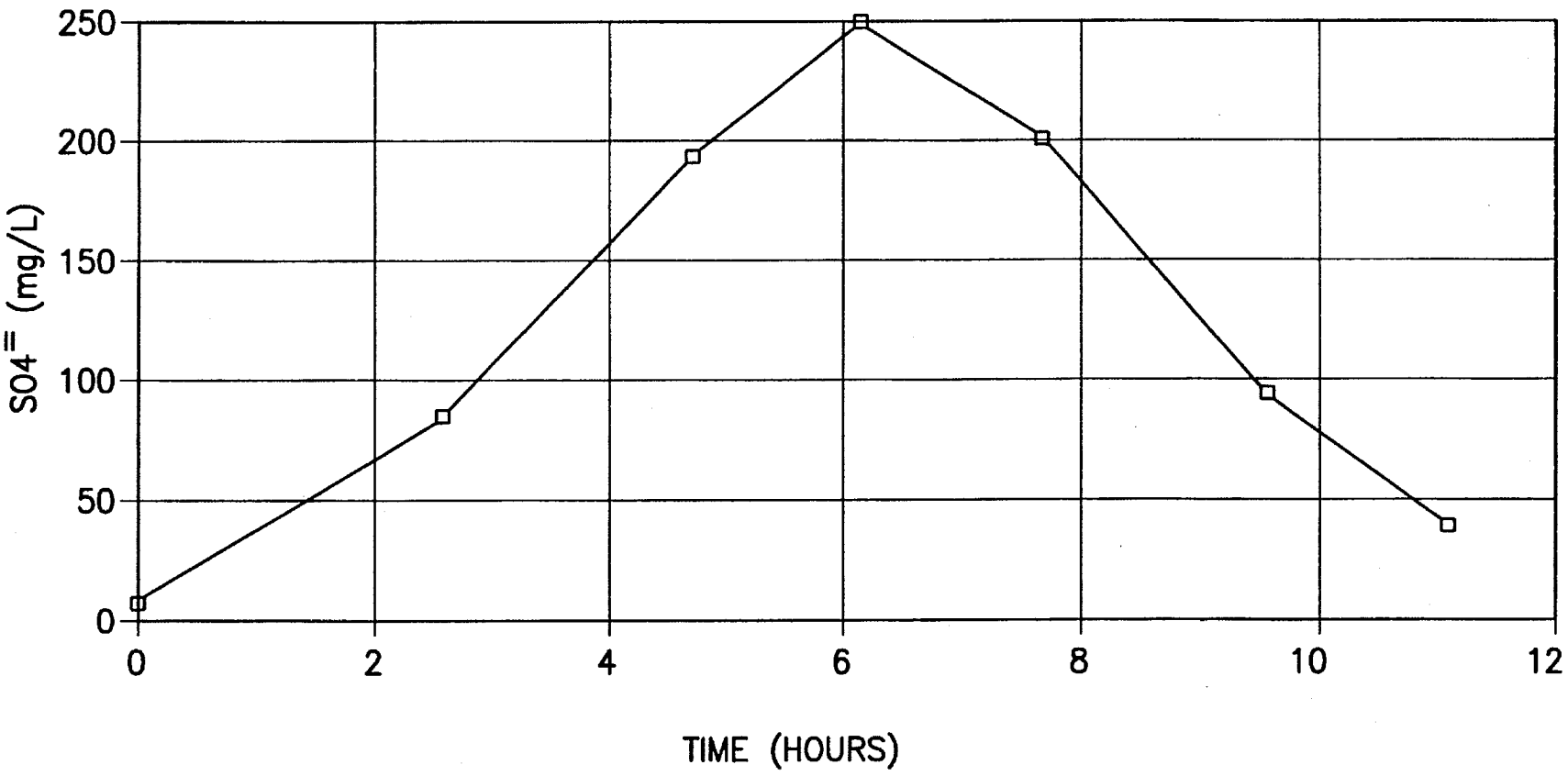
FIG. 5 is a graph depicting the dissolved sulfate concentration of the quench chamber water of the partial oxidation reactor during controlled oxidation.

As can be seen in FIG. 5, which is a graph depicting the sulfate concentration profile, or progression in sulfate concentration measurement in the quench water during controlled oxidation, maximization of sulfate concentration is indicative of maximum accumulation of slag in the quench water. An indication that controlled oxidation conditions can end is when there is a consistent and steady decrease in sulfate concentration after it reaches a maximum, thereby signalling that most of the slag has been removed from the gasifier.

What is claimed is:

1. A method for monitoring the removal of accumulated slag during controlled oxidation conditions for deslagging a partial oxidation reactor, said reactor having a quench chamber containing quench water wherein said slag accumulates during partial oxidation conditions, comprising:

(i) establishing controlled oxidation conditions in the reactor and removing accumulated slag;

(ii) measuring at least one quench chamber water parameter selected from the group consisting of pH, conductivity, total dissolved solids and sulfate concentration of the quench water, wherein the change in the measured value of each of the above identified parameters independently corresponds to the removal of accumulated slag;

(iii) collecting and recording data from measuring at least one of the selected quench chamber water parameters;

(iv) monitoring the recorded data during controlled oxidation conditions to determine when maximum value is recorded for at least one parameter selected from the group consisting of conductivity, total dissolved solids, and sulfide concentration, or when a minimum value is recorded for the pH parameter, wherein a consistent and steady decrease in recorded measured values after a the maximum value or a consistent and steady increase in recorded measured values after a minimum value of the selected quench chamber water parameter is an indication that most of the slag has been removed from the reactor; and (v) wherein after the maximum or minimum value of the selected quench chamber water parameter occurs and most of the slag has been removed from the reactor, controlled oxidation conditions are stopped and partial oxidation conditions are restored to the reactor.

2. The method of claim 1, wherein the slag comprises at least one oxide and/or sulfide of a transition metal selected from the group consisting of vanadium, molybdenum, chromium, tungsten, manganese and palladium.

3. The method of claim 2, wherein the slag comprises oxides and/or sulfides of vanadium.

4. The method of claim 1, wherein the controlled oxidation conditions comprise operating the reactor at a temperature of about 1000°–1500° C. and an oxygen partial pressure of about 1–10% of the reactor pressure of about 10–200 atmospheres for about 2 to 24 hours.

5. The method of claim 1, wherein the selected quench chamber water parameter is pH.

6. The method of claim 1, wherein the selected quench chamber water parameter is conductivity.

7. The method of claim 1, wherein the selected quench chamber water parameter is total dissolved solids.

8. The method of claim 1, wherein the selected quench chamber water parameter is sulfate concentration.

9. The method of claim 1, wherein the parameters are measured by installing monitoring equipment on a quench water outlet line.

10. The method of claim 1, wherein the parameters are measured by laboratory analysis of quench water samples.

* * * * *